United States Patent [19]

Brooks et al.

[11] 4,136,835

[45] Jan. 30, 1979

[54] BUILDER MECHANISM FOR TEXTILE MACHINE

[75] Inventors: Frank E. Brooks, Seneca; Guenther C. Wunderlich, Easley, both of S.C.

[73] Assignee: Platt Saco Lowell Limited, Rossendale, England

[21] Appl. No.: 887,269

[22] Filed: Mar. 16, 1978

[51] Int. Cl.[2] ..... B65H 54/36

[52] U.S. Cl. ..... 242/26.4; 242/26.45

[58] Field of Search ..... 242/26.4, 26.45, 26.1, 242/26.2, 26.3, 43, 43.1, 158 R, 158.2, 158.4 R; 57/99

[56] References Cited

U.S. PATENT DOCUMENTS

| | | | |
|---|---|---|---|
| 678,408 | 7/1901 | Lengweiler | 242/26.45 |
| 2,982,487 | 5/1961 | Newton | 242/26.1 |
| 3,072,350 | 1/1963 | Anderson et al. | 242/26.4 X |
| 3,097,475 | 7/1963 | Hooper et al. | 242/26.2 X |
| 3,325,109 | 6/1967 | Pray et al. | 242/26.4 X |
| 3,369,764 | 2/1968 | Whittaker et al. | 242/26.3 |
| 3,547,363 | 12/1970 | Baglino et al. | 242/26.3 |
| 3,803,825 | 4/1974 | Einaudi | 242/26.1 X |
| 3,811,628 | 5/1974 | Glazener | 242/26.4 X |
| 3,921,924 | 11/1975 | Ayers et al. | 242/26.4 X |

*Primary Examiner*—Stanley N. Gilreath

*Attorney, Agent, or Firm*—Joseph H. Heard; Donald H. Feldman

[57] ABSTRACT

All control components of the builder mechanism and its pick motion device are concentrically arranged about the builder shaft of a textile machine in such manner that the builder mechanism can readily be removed from the builder shaft as an entity for replacement, inspection, repair or substitution of parts, creating a compact construction of great durability and easy maintenance. Such concentrically disposed components include electromechanical control means for at prescribed times effecting directional reversals and stepped advancements of the points of movement reversals of the builder shaft with a differential gearing assembly which produces incremental angular advancements of switch components about the axis shaft when driven by pick-gear wheel and pick-gear pawl members thereof.

10 Claims, 6 Drawing Figures

BUILDER MECHANISM FOR TEXTILE MACHINE

BACKGROUND OF THE INVENTION

This invention relates to a builder machanism for textile machines. More particularly, it relates to an improved, extremely compact builder mechanism of the electromechanical type which controls the extents of reciprocatory vertical movements of machine elements which layer fibrous strands onto cops, such as the movements of ring rails in spinning machines or the movements of roving spindles in speed frames. The present builder includes an electromechanical control means concentric to a builder shaft which is interconnected with a reversible drive means for the aforesaid machine elements, the present control means including a differential gearing assembly which effects with time of machine operation incremental angular advancements of switch components interconnected with the drive means to effect reversals by means of pick gear and pick gear pawl members also disposed concentric to the builder shaft's axis. By such concentric construction, the present builder is extremely compact and imparts the advantage of being installed or removed from the builder shaft as a unit for maintenance in extremely short time intervals with concomitant economic benefits of reducing unproductive intervals of machine downtime for such maintenance.

In contast, mechanical builder mechanisms conventionally employed effect control over the change in reversals of reciprocatory elements of most ring spinning or roving machines through the use of a builder cam interconnected by mechanical elements to the builder shaft to effect required stepped advancements of the points of reciprocatory reversals in vertical movement of the strand layering elements. Typical of such prior art constructions are the builders shown, for example, in U.S. Pats. Nos. 678,408; 2,982,487; 3,072,350; 3,325,109; and 3,369,764.

Attempts have been made to move away from the all mechanical type builder mechanisms in order to provide certain advantages. Among these are the electromechanical builder mechanisms which possess the potential to provide a more instantaneous control response in the patterning of reciprocatory stroke reversals than the all mechanical systems, thus to hold forth the promise of providing a more precise patterning of strand layers on a cop than mechanical mechanisms which are limited in this regard because of time lags induced in the transmission of movement by multiple mechanical linkages. Typical ones of proposed electromechanical builders are disclosed by U.S. Pats. Nos. 3,097,475; 3,367,588; 3,461,747; 3,477,654; 3,484,050; and 3,547,363.

In such prior art mechanical and electromechanical builder mechanisms it is to be readily noted that their components are fixed to and distributed among a plurality of shafts or other supporting elements which are spaced apart or otherwise physically disassociated from one another. Such arrangements can provide disadvantages and problems in that various components may be located where they may, for example, be exposed to unauthorized tampering and/or to damage, as from accidental impacts, lint accumulations, and the like. Additionally, such arrangements may impede an operator's ready access for adjustment of certain components which normally must be adjusted when it is desired to change the configuration or "build" of the strand packages to be produced. Further and perhaps most importantly, such arrangements tend to provide extended machine downtimes for maintenance work which would be required, such as to remedy malfunctions of the builder mechanism especially when occurring for some unapparent and not immediately ascertainable reason. Thus, with prior art arrangements the textile machine may remain idle while each of the various control components of the builder mechanism is individually removed and examined to locate the source of malfunction, and until the malfunctioning component is identified and replaced. Such idle intervals may be of several hours to several days in duration because of the difficulties involved in removing the separated components, their examination and replacement. This has imposed substantial economic disadvantages by removing the machine from production for these prolonged intervals. A yet further economic disadvantage present in prior art constructions resides in the requirement for substantial space to house these builder mechanisms with their dispersed components. With the ever increasing rise in costs of already expensive floor space in commercial textile mills, the economic disadvantages inherent in such prior art mechanisms are manifest.

OBJECTS OF THE INVENTION

Thus it is an object of the invention to provide a very compact builder mechanism for textile machines, wherein the control adjustment components of which are readily accessible and the builder mechanism as an entity is quickly removable and replaceable as a unit.

Other desirable objects of the invention will become apparent through the explanations which follow.

SUMMARY OF THE INVENTION

The present invention provides, in association with an electromechanical builder mechanism of the type having reversing-switch components mounted in adjacent relationship to an oscillatorily-movable builder shaft for movement along arcuate paths of travel concentric with such shaft, of pick-mechanism components which also are all mounted in adjacent relationship to such shaft and which are intermittently driven from said shaft along paths of travel concentric therewith at desired intermittent times to advance the angular positions of certain of the switching components about the shaft axis and thereby cause desired advancement of the reciprocatory strokes of the ring rails of the spinning machine with which the builder mechanism is associated. The aforesaid pick mechanism includes a differential gearing assembly and a pick gear each disposed in concentric relationship to the axis of the oscillatorily-movable shaft, and further includes means carried by and movable in unison with such shaft about its axis for at desired times imparting a driving input to the differential gearing assembly through the pick gear. In a preferred embodiment of the invention the aforesaid means for imparting a driving input to the pick gear comprises pawl means which may be and preferably is carried by an arm affixed to the oscillatorily-movable shaft and supporting other switching components for oscillatory movement in unison with said shaft about its axis. Such arm may and preferably does also comprise part of means for effecting return movement of certain control components of the builder mechanism about the axis of the builder shaft during wind-down of the ring rails of the spinning machine following each package-forming operation, which return movement is facilitated by then-transpiring free rotation of a normally-restrained control gear of the differential gearing assembly.

By adjustment of the positions of appropriate components of the builder mechanism about the axis of the builder shaft, which adjustment can be readily effected, the length of the reciprocatory strokes of the spinning-machine ring rails, and/or the magnitude of the advancement or "gain" of such strokes may be varied as desired.

DESCRIPTION OF THE DRAWINGS

Still other objects and benefits of the invention will be in part apparent and in part pointed out specifically hereinafter in the following description of an illustrative embodiment thereof, which should be read in conjunction with the accompanying drawings in which.

DESCRIPTION OF THE PREFERRED EMBODIMENT

Figure 1:
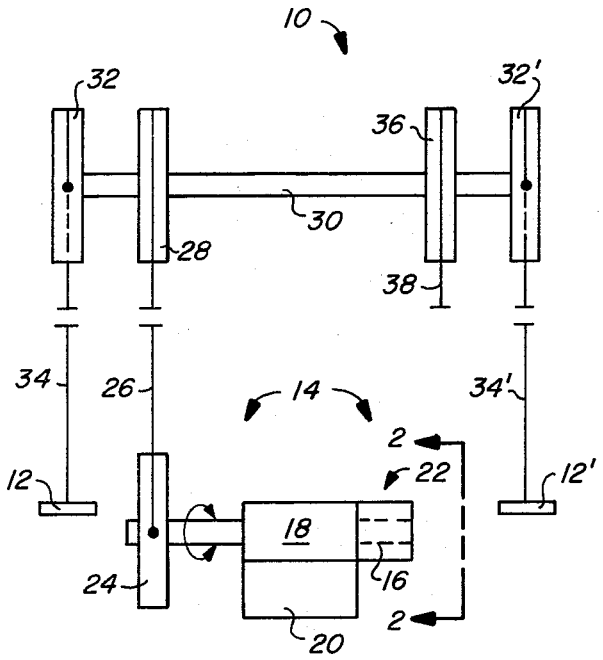
FIG. 1 is a schematic end-elevational view of the ring rails of a textile spinning machine and of the means, including a builder mechanism in accordance with the present invention, for imparting vertical movement to such ring rails.
Figure 2:
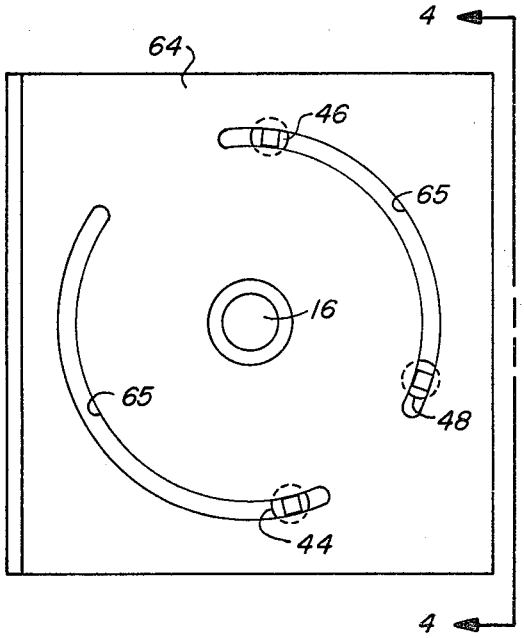
FIG. 2 is an enlarged front elevational view, taken approximately in the direction of the arrows 2—2 of FIG. 1, of a cover plate for and some associated control components of the builder mechanism control means.

The textile spinning machine 10 fragmentarily and schematically shown in FIG. 1 includes vertically movable ring rails 12,12' and a builder mechanism 14 having a center shaft 16 extending through a gear box 18 and driveable in opposite directions by reversible drive means 20 controlled by control means 22 disposed adjacent one end portion, illustratively the right end portion as viewed in FIG. 1, of shaft 16. A drum 24 upon the opposite end portion of shaft 16 (the left end portion, as viewed in FIG. 1) is connected by a chain 26, or other elongate flexible member, to another drum 28 mounted thereabove upon a windlass shaft 30 which in turn is conventionally connected to ring rails 12,12' as by means of drums 32,32' and associated tapes 34,34'. Windlass shaft 30 is also connected as by a drum 36 and associated chain 38 or the like to suitable biasing means (not shown) which partially counter-balances the weight of ring rails 12,12'. The foregoing innerconnection therebetween causes ring rails 12,12' to move either upwardly or downwardly in response to rotation of builder shaft 16, and illustratively is such that the ring rails move upwardly when shaft 16 is rotated in a counterclockwise direction, as viewed from the direction of the arrows 2—2 of FIG. 1, and are moved downwardly when shaft 16 is rotated in a clockwise direction.

Figure 6:
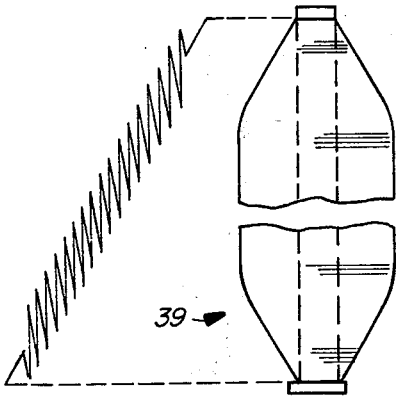
FIG. 6 is a schematic representative of a filling-wind yarn-package that is produceable by the builder mechanism.

For the production by machine 10 of filling-wind packages, such as the one 39 illustrated in FIG. 6, builder shaft 16 should be driven by drive means 30 through oscillatory strokes which are progressively advanced in a counterclockwise direction about the shaft axis, thereby causing ring rails 12,12' to be moved through vertical reciprocatory strokes which progressively advance upwardly. To "wind-down" rails 12,12' at the completion of a package builder operation, builder shaft 16 should be rotated in a clockwise direction by drive means 20. The aforesaid and other desired results are produced by the builder control means 22 associated with the right end portion of shaft 16, as viewed in FIG. 1, and more specifically illustrated in FIGS. 2–5, to which reference is now made.

Control means 22 includes switching components illustratively in the form of a plurality of encapsulated and magnetically-actuable reed switches 40,42,44,46 and 48, and a pair of switch-actuating magnet elements 50,52. Magnets 50,52 are respectively affixed to opposite ends of a stud 54 (see particularly FIG. 4) carried by and extending through the outer end portion of an arm member 56 fixedly but adjustably secured adjacent its inner end, as by a set screw 58 (FIG. 5), to the terminal end-portion of shaft 16. Rotation of shaft 16 causes simultaneous angular movement of magnets 50,52 along arcuate paths of travel concentric with and radially spaced from the shaft axis. Plate members 43, 60 (see particularly FIG. 3), the latter having an arcuate slot 62 therein, are mounted, in a manner described more fully hereinafter, for angular movement about shaft 16. Reed switches 40, 42 are respectively carried by plates 43, 60 for angular movement in unison along an arcuate path of travel concentric with the axis of shaft 16 and in laterally-spaced adjacent relationship to the arcuate path of travel of magnet 50 upon the rear end of the stud 54 carried by arm 56. Switches 40, 42 are each effective, when actuated during regular package-building operation of machine 10 by proximity of magnet 50 thereto, to effect reversal of drive means 20 and thus reversal of the directions of movement of shaft 16 and ring rails 12, 12'. The angular spacing between switches 40, 42 therefore determines the length of the oscillatory or reciprocatory strokes of movement of shaft 16 and ring rails 12, 12' during normal package-building operation of machine 10, and angular advancement of the positions of such switches 40, 42 about the axis of shaft 16 causes corresponding advancement of strokes of movement of shaft 16 and ring rails 12, 12'.

The remaining reed switches 44, 46 and 48 are all carried by a cover plate 64 (FIGS. 2 and 4) pivotally or otherwise removably mounted in any suitable manner adjacent the free end of shaft 16. Plate 64 has arcuate slots 65 therein which mount such switches for angular adjustive movement along arcuate paths of travel concentric with the projected axis of shaft 16 and in laterally-adjacent spaced relationship to the angular path of travel of the magnet 52 upon the forward end of the stud 54 carried by arm 56. Actuation of switch 44 by magnet 52 at the completion of each package-building operation then causes drive means 20 to rotate shaft 16 in a clockwise direction, thus "winding down" ring rails 12, 12'. Actuation of switch 48 by magnet 52 terminates the foregoing rotation of shaft 16 by drive means 20 and its angular position is therefore determinative of the lowered position to which rails 12, 12' are "wound down". For a brief period of time at the commencement of a package-building operation by a spinning machine, the ring rails are normally caused to undergo a "jogging motion" movement through reciprocatory strokes of preselected desired lenth. Switch 42 establishes the lower limit of such "jogging motion" strokes, as well as the lower limits of the normal package-building strokes of the ring rail. However, the upper limit of the "jogging motion" strokes is established not by switch 40, which is disabled during the jogging operaton, but rather by switch 46, which is actuable by magnet 52. The length of the "jogging motion" strokes may therefore be adjusted as desired by varying the position of switch 46 longitudinally of its associated slot 65. Upon completion of the jogging operation, control of drive means 20 is again assumed by switches 40, 42 and magnet 50.

The above-described features of builder mechanism 14 are generally similar to ones disclosed in prior U.S. Pat. Nos.

3,811,628 and/or 3,861,130, to which reference may be made for a more detailed explanation if desired.

In accordance with one aspect of the present invention, to be now described, improved means are provided in closely adjacent concentric relationship to shaft 16 for effecting periodic advancement of switches 40,42 in a counterclockwise direction about the axis of such shaft during package-building operation of machine 10, and for effecting clockwise return movement of such switches about the shaft axis during and in response to the "winding-down" clockwise rotation of shaft 16 at the completion of each package-building operation.

Figure 3:
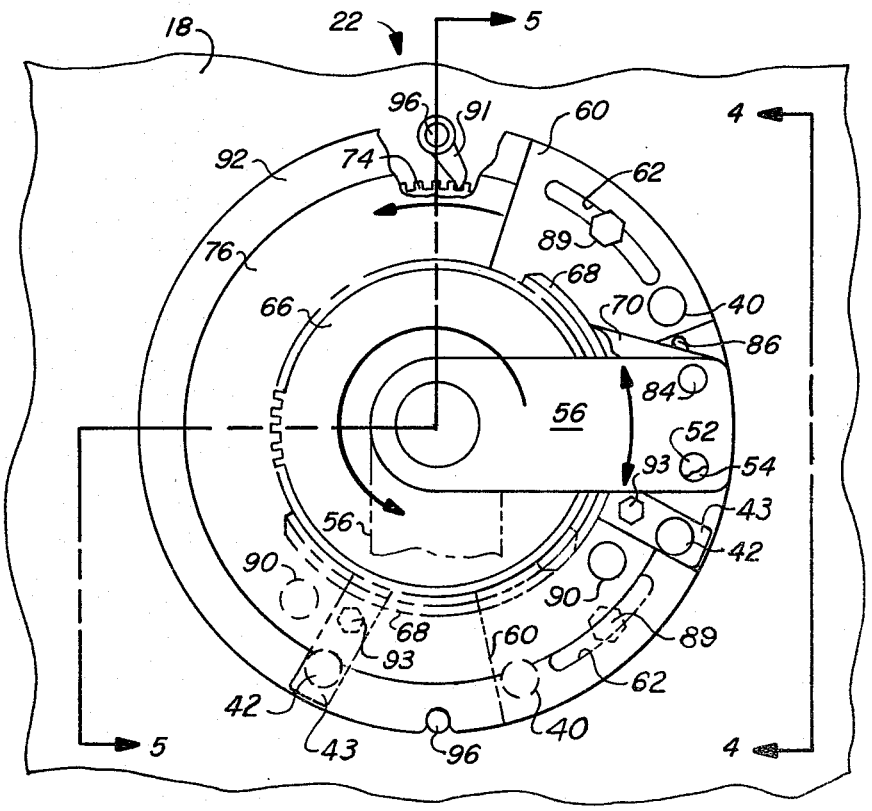
FIG. 3 is a further enlarged front elevational view of the builder mechanism control means, showing those control components thereof behind the cover plate illustrated in FIG. 2.
Figure 4:
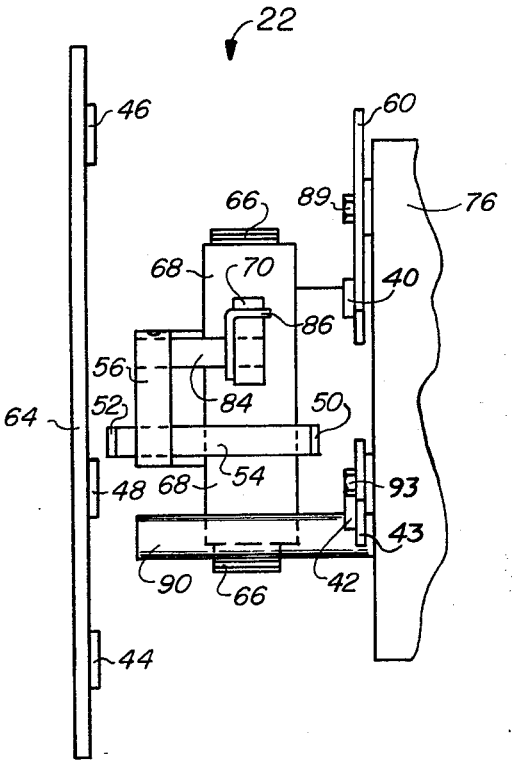
FIG. 4 is a composite side elevational view, taken approximately in the direction of the arrows 4—4 of FIGS. 2 and 3 and enlarged with respect to FIG. 2, of builder mechanism control components shown in FIGS. 2 and 3.
Figure 5:
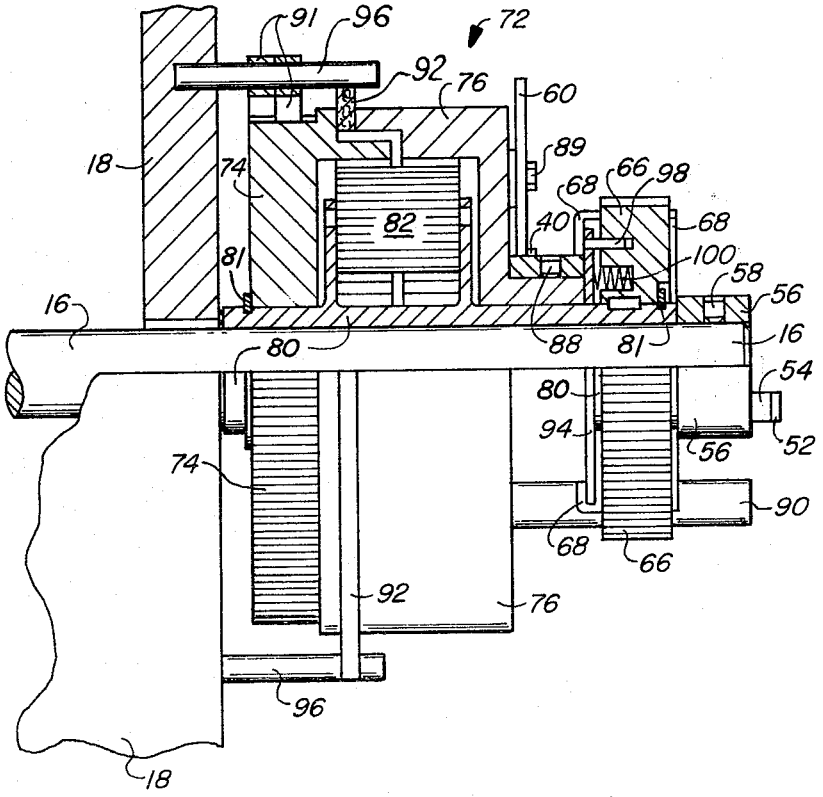
FIG. 5 is a view taken approximately along the line 5—5 through the builder mechanism control components of FIG. 3 and showing the same partially in vertical section and partially in side elevation.

As shown in FIGS. 3–5, such means includes a pick gear 66, a pick-gear shroud member 68, a pick-gear pawl 70 (shown only in FIGS. 3 and 4), and a differential gearing assembly 72 having ring gears 74, 76 and planetary gearing including a planet carrier 80 mounting at least one planetary gear 82. All of the aforesaid components are disposed in concentric relationship to that portion of builder center shaft 16 intermediate gear box 18 and arm 56, for movement at desired times along arcuate paths of travel concentric with the axis of such shaft. As is best shown in FIG. 5, the sleeve-like hub portion of planet carrier 80 is journaled upon the aforesaid portion of shaft 16 and extends along substantially its entire length between gear box 18 and arm 56. Releasable retaining rings 81 encircle the hub portion of planet carrier 30, adjacent its opposite end portions, and restrain axial movement of the gears 74, 76, 66 which are supported upon the hub portion of planet carrier 80. Ring gears 74, 76 are independently journaled upon the hub of planet carrier 80, for rotation relative such hub in spaced adjacent relationship to each other and with their internal gear teeth in innermeshing relationship with planet gear 82. Pick gear 66 is keyed or otherwise fixedly secured to that end portion of the hub of planet carrier 80 adjacent arm 56. Pick-gear pawl 70, best shown in FIG. 4, is pivotally mounted adjacent the periphery of pick gear 66 by a stud 84 carried by arm 56. A spring 86 (FIGS. 3 & 4) biases the free end of pawl 70 toward the periphery of pick gear 66. The hub portion of shroud 68 is fixedly but adjustably secured, as by means of a set-screw 88, upon the hub of ring gear 76 for rotative movement therewith about the axis of shaft 16. Switch-mounting plates 43, 60 are respectively secured as by bolts 93, 89 to the forward most radical face of ring gear 76. Bolt 89 extends through the arcuate slot 62 within plate 60. This permits the arcuate distance between the switches 42, 40, respectively carried by plates 43, 60, to be readily adjusted when and as desired by simply loosening bolt 89 and adjusting the arcuate position of plate 89 relative to plate 43. Lastly, a stud member 90 projects forwardly from gear 76, for a purpose to be subsequently described.

For controlling the freedom of the aforesaid components for rotative movement in certain desired respects, there are provided in association therewith restraining means including a pawl 91 (FIGS. 3 and 5), and drag means including two annular discs 92,94. Pawl 91, which as indicated in FIG. 5 may for more reliable operation comprise plural elements of slightly differing lengths, is pivotally mounted upon the uppermost one of a plurality of studs 96 carried by and projecting forwardly from the face of the gear box 18. The free end of pawl 91 engages teeth provided about an adjacent part of the peripheral surface of ring gear 74. Such engagement prohibits counterclockwise rotation of ring gear 74, but permits its clockwise rotation. Studs 96 also serve to support disc 92, which is formed of material having a relatively high coefficient of friction, between radially-extending surfaces provided upon the confronting faces of ring gears 74,76. Engagement between friction disc 92 and the aforesaid surfaces of ring gears 74,76 is maintained by the second disc 94 and biasing means associated therewith. Disc 94 loosely encircles that portion of the hub of planet carrier 80 intermediate pick gear 66 and the adjacent radial surfaces of the hubs of ring gear 76 and shroud member 68. Pin elements 98 (FIG. 5) project forwardly from disc 94 into cooperating bores provided within the rearward radial face of pick gear 66, and secure disc 94 and pick gear 66 for rotary movement in unison with one another while permitting movement of disc 94 in the axial direction of shaft 16. Housed within suitable recesses also provided in the rearward radial face of pick gear 66 are a plurality of compression springs 100, one of which is shown in FIG. 5, which bias disc 94 into engagement with the adjacent radial faces of the hubs of ring gear 76 and shroud 68. Such engagement in turn biases ring gear 76 against friction disc 92, and maintains frictional engagement of such friction disc with both ring gears 74,76. The magnitude of the frictional engagement of disc 92 with ring gears 74,76 is such as to prevent machine vibration and the like from causing "creeping" rotary movement of the ring gears, and particularly ring gear 76 and the components secured to it, at those times during which differential gearing assembly 72 is not being driven and its components are intended to remain stationary. On the other hand, the magnitude of the aforesaid frictional engagement between disc 92 and ring gears 74,76 is sufficiently small as to permit rotative movement of gear 76 relative to gear 74 when assembly 72 is positively driven.

Referring now particularly to FIG. 3, assembly 72 is periodically positively driven during normal package-building operation of machine 10. The solid and phantom-line showings in FIG. 3 of switch-plate 43 arm 56, switch-plate 60, shroud 68 and ring gear 76 respectively represent positions occupied by such components during initial and terminal phases of a package-building operation by machine 10. As indicated by the double-headed arrow upon arm 56, and as previously described, such arm oscillates to and fro between reversing switches 40,42 under the impetus of the oscillatory movement imparted to shaft 16 by drive means 20 and the reversals of its driving input which are effected by the alternating proximity-actuation of reed switches 40,42 by magnet 50 (FIG. 4) carried by arm 56. During the final counterclockwise part of each oscillatory stroke of movement of arm 56 the pawl 70 which is carried by such arm, and which normally rides upon the shroud 68 overlying the adjacent portion of the peripheral surface of pick gear 66, is advanced past the leading end (the uppermost end, as viewed in FIG. 3) of shroud 68. The free end of pawl 70 thereupon engages the toothed periphery of pick gear 66 and, under the impetus of that final counterclockwise rotation of shaft 16 and arm 56 occurring immediately prior to actuation of switch 40 by magnet 50 (FIG. 4), imparts limited counterclockwise rotative movement — the magnitude of which is determined by the adjustive angular position in which set screw 88 (FIG. 5) secures shroud 68 to the hub of ring gear 76 — to pick gear 66. Since pick gear 66 is keyed or otherwise suitably affixed to the hub of planet carrier 80 of differential gearing assembly 72, the aforesaid rotation of the pick gear causes counterclockwise rotation of planet carrier 80 and ensuing clockwise rotation of the planet gear or gears 82 carried thereby and meshing with the internal gear teeth of ring gears 74,76. Inasmuch as pawl 91 prohibits counterclockwise rotation of ring gear 74, which constitutes the "control" gearing member of assembly 72, the net effect of the foregoing driving input into assembly 72 from shaft 16 to produce a limited angular advancement, in a counterclockwise direction, or "output" ring gear 76 and the components carried by and movable with it; i.e., shroud 68, plates 43, 60, switches 40, 42, and stud 90. The magnitude of such angular advancement of ring gear 76 and the aforesaid associated components is of course much less than the magnitude of the pick-gear rotation which produced it, due to the fact that the internal gear teeth upon the respective ring gears 74, 76 differ only slightly in number.

Due to the aforesaid advancement of switch plates 43, 60, and more particularly due to the advancement of the reed switches 40, 42 carried thereby and determinative of the extremities of each stroke of oscillatory movement of shaft 16 and arm 56, the next-ensuing one of such strokes will be correspondingly advanced in a counterclockwise angular direction about the axis of shaft 16, causing upward advancement of the then simultaneously-ensuing reciprocatory stroke of ring rails 12, 12' (FIG. 1). Similar stepped advancements of the components continue to occur until the package-building operation is completed, at which time ring rails 12, 12' will occupy their uppermost positions and arm 56 and ring gear 76, together with the components carried by and movable in unison with such ring gear, will occupy extreme counterclockwise positions adjacent those indicated in phantom lines in FIG. 3. Actuation of cover-plate reed switch 44 (FIGS. 2 & 4) by magnet 52 (FIGS. 3 & 4) then causes drive means 20 to rotate shaft 16 in a clockwise direction and thus "wind-down" ring rails 12, 12'. Such movement of shaft 16 and ring rails 12, 12' is haulted by magnet 52 actuating cover-plate reed switch 48 (FIGS. 2 and 4) when arm 56 has been rotated back to its initial angular position (not shown, but adjacent in a counterclockwise direction to the solid-line showing of arm 56 in FIG. 3).

During the above-described "wind-down" movements of shaft 16 and arm 56 in a clockwise direction, arm 56 engages the stud 90 carried by and projecting forwardly from ring gear 76 and, under the impetus of such engagement, rotates ring gear 76 and the additional components carried by it (i.e., shroud 68, switch plate 43, 60, and switches 40, 42) back to their original angular positions shown in solid lines in FIG. 3. This return movement of ring gear 76 in a clockwise direction occurs without overstressing any components of differential gearing assembly 72 due to the fact that pawl 91 permits clockwise rotation of ring gear 74 at such time, as a consequence of which planet carrier 80 remains substantially stationary. The return movement of ring gear 76 and the components carried by it is of course not dependent upon the "wind-down" step being initiated by switch 44. Such return movement would still transpire in the described manner if "wind-down" were initiated in other ways, as by a switch actuable by a yardage-counter (not shown) or one manually operable by a machine-operator. It would also still transpire if the clockwise rotation of shaft 16 were producted manually, as by the provision of a hand-crank (not shown) driveably engagable therewith. However wind-down of rails 12, 12' might be initiated or produced, it will therefore be apparent that at the completion thereof all components of builder control means 22 will be properly positioned for the next package building operation of machine 10.

The compact arrangement of all components of builder control means 22 adjacent an end portion of shaft 16 is desirable for various reasons. It permits the control components and adjacent portion of shaft 16 to be housed within a locked compartment of an end-cabinet (not shown) of machine 10 where they are shielded from lint and dirt and are secure from unauthorized tampering, but are all readily accessible to authorized personnel for purposes of adjustment or the like. In the latter connection, adjustment of the lengths of the package-building strokes of movement of shaft 16 and ring rails 12, 12' may be readily effected by varying the angular distance between switches 40, 42. As previously described, this is accomplished simply by loosening bolt 89, moving plate 60 relative to plate 43, and then retightening bolt 89. Adjustment of the "gain" effected by control means 22 may be realized with equal ease in the manner previously noted; i.e., by loosening set-screw 88 (FIG. 5) and varying the angular position of shroud 68 about the hub of ring gear 76. At such time as set-screw 58 is loosened, it will also be appreciated that all components of the present mechanism may, if desired, be removed completely from shaft 16 simple by sliding the same forwardly past the shaft's free end. This capability greatly facilitates installation, inspection and maintenance of the builder mechanism.

While a preferred embodiment of the invention has been specifically shown and described, this was for purposes of illustration only, and not for purposes of limitation, the scope of the invention being in accordance with the following claims.

That which is claimed is:

1. In a builder mechanism for vertically moving the ring rails of a textile spinning machine during package building operation thereof through progressively advancing reciprocatory strokes; said builder mechanism including a shaft movable substantially synchronously with said ring rails in opposite rotative directions through progressively advancing oscillatory strokes; first switching means adapted to be periodically advanced along an arcuate path of travel substantially concentric with and spaced radially from the axis of said shaft; and second switching means connected to said shaft for movement therewith into and out of cooperating relationship with said first switching means along an arcuate path of travel adjacent that of said first switching means; the improvement comprising:

a pick gear mounted in concentric relationship to said shaft for rotative movement about the axis thereof;

pawl means connected to and movable in unison with said shaft adjacent said pick gear for rotating said pick gear a predetermined angular distance about the axis of said shaft during a portion of each of said oscillatory strokes of movement of said shaft;

and differential gearing means concentric with said shaft and innerconnecting said first switching means and said pick gear for advancing said first switching means along said arcuate path of travel thereof in response to rotation of said pick gear.

2. Apparatus as in claim 1, and further including an elongate arm member extending generally radially of said shaft, said arm member being secured adjacent one end thereof to said shaft for movement therewith, and said second switching means and said pawl means each being carried by said arm member adjacent the other end thereof for angular movement in unison therewith about the axis of said shaft.

3. Apparatus as in claim 2, wherein at the completion of a package forming operation said shaft and said ring rails undergo return movement in directions opposite to the directions of the progressive advancement of said strokes thereof, and further including means associated with said differential gearing assembly and cooperable with said arm member secured to said shaft for in response to return movement of said shaft imparting return movement to said first switching means in a direction opposite to the direction of advancing movement of said first switching means along said arcuate path of travel thereof.

4. Apparatus as in claim 1, and further including a shroud member extending in overlying adjacent relationship to the toothed surface of said pick gear for shielding said pick gear from engagement with and rotation by said pawl means except during said portion of each oscillatory stroke of movement of said shaft, said shroud member being connected to said differential gearing means for angular advancing movement thereby in unison with said first switching means about the axis of said shaft during package building operation of said machine.

5. Apparatus as in claim 1, wherein said differential gearing means includes input gearing means connected to said pick gear for rotation thereby, a control gear, and an output gear adapted to undergo differential rotation in response to rotation of said input gearing means and in a direction effecting advancement of said first switching means when said control gear is restrained from rotation in said direction, and further including restraining means for preventing rotation of said control gear in said direction while permitting rotation of said control gear in the opposite direction.

6. Apparatus as in claim 5, wherein said input gearing means comprises a planetary gearing member including a planet carrier and at least one planet gear carried thereby, and wherein said control and output gears respectively comprise first and second internally-toothed ring gears mounted in spaced confronting relationship to each other and intermeshing relationship with said planet gear, said first ring gear further having external teeth thereon, and said restraining means including pawl means engagable with said external teeth upon said first ring gear for preventing rotation thereof in said one direction while permitting rotation thereof in the said opposite direction.

7. Apparatus as in claim 6, and further including drag means for discouraging rotative creeping movement of said gears of said differential gearing assembly relative to each other under the impetus of machine vibration and the like.

8. Apparatus as in claim 7, wherein said drag means includes an annular disc of frictional material disposed between adjacent confronting surfaces of said ring gears.

9. Apparatus as in claim 8, wherein said drag means further includes biasing means for maintaining engagement between said disc and said surfaces of said ring gears.

10. Apparatus as in claim 9, wherein said biasing means include at least one spring element mounted in abutting engagement with said pick gear, for rotative movement in unison with, between said pick gear and said differential gearing assembly.

* * * * *